United States Patent [19]

Hoagland

[11] 3,937,368

[45] Feb. 10, 1976

[54] AEROSOL ACTUATOR NOZZLE

[75] Inventor: Harold G. Hoagland, Croton-on-Hudson, N.Y.

[73] Assignees: Elmer Hoagland, North Bergen, N.J.; Curtis Ailes, Mt. Kisco, N.Y. ; part interest to each

[22] Filed: Feb. 28, 1975

[21] Appl. No.: 554,102

Related U.S. Application Data

[63] Continuation-in-part of Ser. No. 459,697, March 10, 1974, and a continuation-in-part of Ser. No. 496,409, Aug. 12, 1974, which is a continuation of Ser. No. 274,195, July 24, 1972, abandoned.

[52] U.S. Cl. ..... 222/402.11

[51] Int. Cl.[2] ..... F16K 35/04

[58] Field of Search .. 222/398, 402.11, 182, 402.21, 222/402.1, 402.24; 251/100, 95, 297

[56] References Cited

UNITED STATES PATENTS 3,721,423 3/1973 Shay ..... 222/402.11 X

*Primary Examiner*—Stanley H. Tollberg

*Attorney, Agent, or Firm*—Curtis Ailes

[57] ABSTRACT

The assembly includes an actuator nozzle telescopically fitted to an aerosol valve and rotatable with respect thereto. The actuator includes a skirt portion which interfits with a locking ring to maintain it on the valve. The interfitted skirt portion is preferably tilted with respect to the telescopically fitted portion of the actuator to provide an initial tilt to the aerosol valve for ease of opening. The locking ring preferably also includes means for locking the actuator by rotation of the actuator to prevent opening of the valve.

14 Claims, 7 Drawing Figures

AEROSOL ACTUATOR NOZZLE

CROSS REFERENCES TO RELATED APPLICATIONS

This application is a continuation-in-part of U.S. Pat. application Ser. No. 459,697 filed Apr. 10, 1974 for an ACTUATOR NOZZLE ASSEMBLY FOR AEROSOL CONTAINERS.

This application is also a continuation-in-part of U.S. Pat. application Ser. No. 496,409 filed Aug. 12, 1974 for A ROTATABLE AEROSOL ACTUATOR NOZZLE and having an effective date of July 24, 1972 because it is a continuation of U.S. Pat. application Ser. No. 274,195 filed July 24, 1972 now abandoned.

This invention relates to an improved actuator nozzle assembly for an aerosol container in which the actuator nozzle is rotatable with respect to the aerosol valve, and which may provided greater ease of operation, or a safety interlock feature, or both.

Aerosol containers are commonly constructed in the form of a metal can having a tubular valve stem protruding at the center of the top of the can. Most commonly, a plastic actuator nozzle is press-fitted over the end of the valve stem, and includes a constricted nozzle opening in one side thereof so that the user can direct the stream from the nozzle in a desired direction. With this method of construction, there is no problem of leakage between the actuator nozzle and the valve stem because of the tight press-fit therebetween. However, the actuator nozzle cannot be easily rotated.

It is one of the features of the present invention to provided an actuator nozzle which can be rotated with respect to the valve stem, and which does not permit leakage between the valve stem and the actuator nozzle.

Aerosol containers, as presently constructed, have valves which are actuated either by pressing the valve stem directly, axially, inwardly, (downwardly), or by tilting the valve stem by a side thrust. The valves that are actuated by a side thrust are preferred because they require less operating force by the user. However, because of proprietary restrictions, some manufacturers are not able to offer the public the side thrust actuated valves, and are restricted to producing and selling the axially operated valves.

It is one object of the present invention to provide an improved aerosol actuator nozzle which promotes ease of operation of the axially operated valves, and which may be said to convert the operation to the tilting type of side thrust operation.

Another problem with aerosol containers is that the substances in the containers, while always very useful, may be harmful if misused. Such misuse may occur through inadvertent operation of the aerosol valve at the wrong time, or the valve may be operated by a young child who may injure himself or cause damage to property.

Accordingly, it is another object of the present invention to provide an improved actuator nozzle assembly for an aerosol container which incorporates an improved interlock feature to provide a locked condition of the actuator whenever accidental or unauthorized operation of the valve is to be prevented.

Further objects and advantages of the invention will be apparent from the following description and the accompanying drawings.

In carrying out the invention, there may be provided an actuator nozzle assembly for an aerosol container of the type having a tubular valve stem protruding at the center of one axial end thereof, comprising an actuator which is rotatable with respect to the valve stem when assembled therewith, said actuator comprising a member defining a cylinder surface operable to telescopically interfit with the valve stem to have a sliding fit therewith, said actuator including a conical surface portion corresponding to a frustum of a right circular cone concentric with said cylinder surface member and arranged to engage an upper edge portion of the valve stem with a distributed radial force combined with an axial force in response to the axial component of valve opening force imparted through said actuator to the valve stem to thereby form a seal between said actuator and the valve stem, said actuator including a nozzle opening communicating with the interior of said cylinder surface member and extending radially outwardly from the upper end thereof, said actuator also including a skirt portion extending downwardly and generally parallel to the axis of said cylinder surface member and having a radially outwardly extending flange at the lower portion thereof, the upper surface of said flange generally defining a plane, a locking ring arranged for assembly to the upper edge portion of the aerosol container, said locking ring having a radially inwardly extending flange portion which interlocks with the upper surface of said radially outwardly extending flange of said skirt portion of said actuator, said plane defined by said upper surface of said radially outwardly extending flange of said skirt portion being tilted away from an orientation perpendicular to the axis of said cylinder surface member, the tilt being downwardly in the front of said nozzle opening and upwardly in the rear of said nozzle opening.

Figure 1:
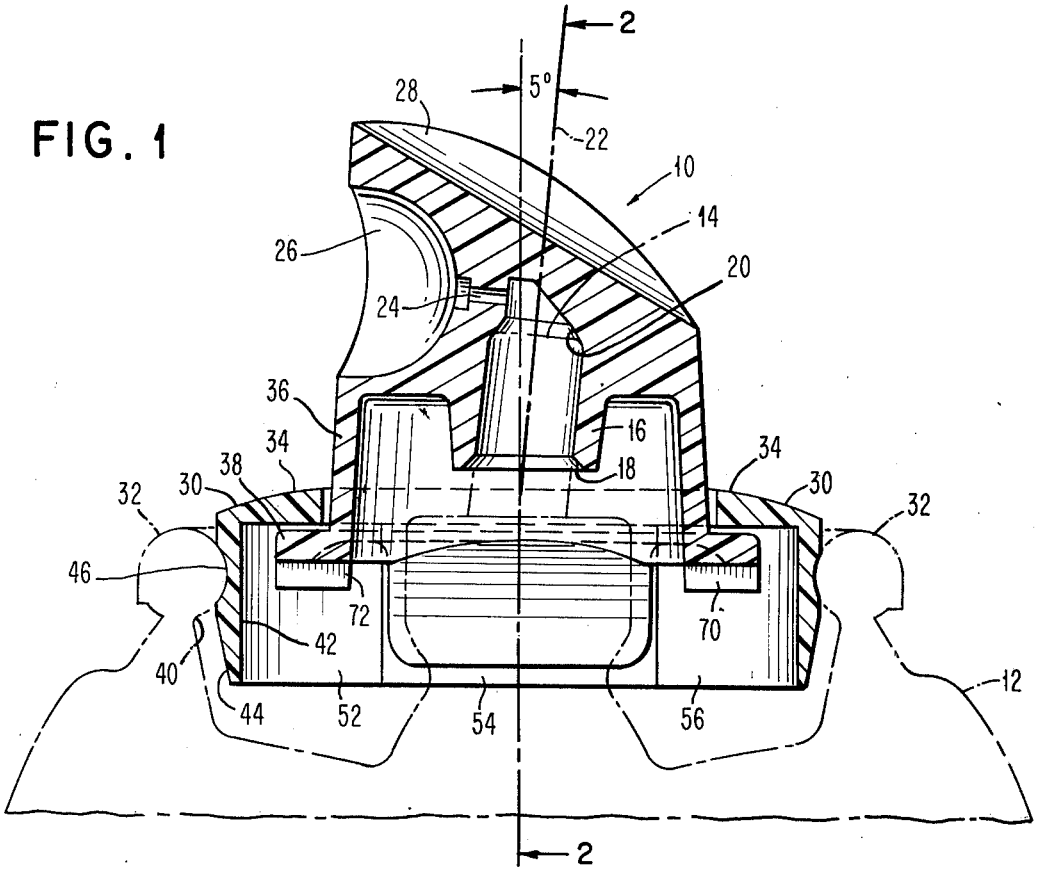
FIG. 1 is a sectional side view of a preferred embodiment of the actuator nozzle assembly of the invention showing the mode of attachment to an aerosol container.

Referring more particularly to FIG. 1, there is illustrated a combined valve actuator and nozzle 10 mounted upon an aerosol container 12. The aerosol container 12 is one of the type having a tubular valve stem 14 protruding at the center of the upper end thereof. The actuator 10 includes a tubular member 16 having an interior cylindrical bore which has a sliding fit telescopically over the outer diameter of the tubular valve stem 14. For ease of assembly, at the bottom tip of the tubular member 16, as indicated at 18, there is provided a tapered portion which adjoins, and forms an extension of, the inner bore surface of the tubular member 16 which engages with the outer surface of the tubular valve stem 14.

The actuator 10 also includes a conical surface portion indicated at 20 which corresponds to a frustum of a right circular cone which is arranged to engage the outer upper edge portion of the valve stem 14 to form a seal therewith to prevent leakage when the valve is actuated. In the embodiment of FIG. 1, surface 20 is simply an extension of the inner bore surface of the tubular member 16. The usual downward pressure on the valve actuator 10 for operation of the valve is sufficient to prevent leakage through this seal. When the valve is actuated by a side thrust upon the actuator nozzle, causing a rotational movement of the actuator and the valve stem 14, the downward and inward component of the actuating force is sufficient to provide the sealing effect. This is explained in more detail below.

For accomplishing the above purposes, the cone angle between the conical surface and the cone axis, corresponding to the axis 22 of the valve stem, is preferably in the neighborhood of 30°. It has been found that if an angle greater than 45° is employed, the sealing action is not adequate with the normal axial valve actuating force. On the other hand, if an angle of less than 20° is employed, the conical portion of the actuator tends to become wedged on the end of the valve stem, preventing free rotation of the combined actuator and nozzle. Accordingly, it is preferred to keep the cone angle within the range from 25° to 40°, and the preferred value is in the neighborhood of 30°. It will be appreciated that the selection of the cone angles, and the operation of the seal, will depend to some extent upon the selection of material for the combined actuator and nozzle. However, the above ranges are believed to be effective for most of the molded plastic materials which are intended to be used for the actuator and nozzle. Various plastic materials may be employed for this purpose The choice of material is not believed to be a critical matter. Typical satisfactory materials include polyethylene, arcylics, vinyls, and others.

The upper end of the center bore of the tubular member 16 communicates with a nozzle bore 24 extending through to the exterior of the actuator and nozzle 10 in the bottom of a concave generally spherically shaped recess 26 formed in the actuator 10. At the upper surface of the actuator 10 there is provided a finger-shaped recessed channel, as indicated at 28, which is axially aligned with the nozzle bore 24 when viewed from above. This is sometimes referred to hereinafter as the finger grip portion of the actuator nozzle. The finger depression 28 is preferably slanted, as shown, as a convenience in actuating the valve by a combination of downward force and side thrust upon the actuator, the side thrust being exerted in a direction to the left in the drawing.

The actuator nozzle 10 is maintained in assembled relationship on the aerosol container by means of a locking ring 30 which snaps into firm engagement with the upper peripheral edge portion 32 of the aerosol container. The locking ring 30 is provided with an inwardly extending radial flange 34. The body of the actuator nozzle 10 includes a skirt portion 36 having a radially outwardly extending flange portion 38 at the bottom edge thereof. The outer diameter of the flange 38 is greater than the inner diameter of the flange 34 so that these flanges interlock to maintain the body of the actuator nozzle 10 in assembled relationship with the aerosol container.

As illustrated in the drawing, the upper edge portion 32 of the aerosol container has an undercut, as indicated at 40, and a portion 42 of the locking ring 30 snaps into the undercut portion of the edge 32 of the container to firmly secure the locking ring thereto. To provide for ease of assembly of the locking ring 30, it is preferably provided with a conically tapered portion indicated at 44, followed by a curved profile portion at 46, above the portion 42, which substantially conforms to the inward facing surface of the edge 32 of the container. The profile portion 46 may be properly referred to as a circumferential groove. The locking ring 30 is preferably constructed of one of the synthetic resin plastic materials previously mentioned above, and when constructed of such materials, it is found to have sufficient flexibility to permit assembly by snapping it into position by use of the camming action provided by the taper 44.

Aerosol containers, as presently constructed, have valves which are actuated either by pressing the valve stem directly, axially, inwardly, (downwardly), or by tilting the valve stem by a side thrust. When the actuator nozzle of the present invention is employed with an aerosol container valve of the first type, involving an axial movment of the valve stem for opening the valve, there is no question about the achievement of an adequate sealing action between the valve stem 14 and the conical surface 20, for the entire axial inward force required to overcome the valve spring is applied directly to force the conical sealing surface 20 against the upper edge of the valve stem 14. However, when the valve is one of those which is actuated by a side thrust, the axial component of that thrust force is necessarily somewhat limited. The axial component of the side thrust is enhanced by two features of the invention. The finger channel 28 at the top of the actuator nozzle 10 body is slanted away from the vertical at an angle which exceeds 45°, and in a preferred embodiment is at an angle of about 54°. This means that in providing a side thrust upon the actuator nozzle, the user necessarily grips the actuator nozzle with his finger by a downward pressure. This provides a component of axial thrust tending to tighten the seal at the conical surface 20. Another feature which is very effective for this problem is that the flange 38 on the skirt 36 of the body of the actuator nozzle engages with the flange 34 of the locking ring at the back of the actuator nozzle as the side thrust and resultant tilting of the actuator nozzle takes place. This is at the right side of the nozzle as it is pictured in the drawing. The engagement of these flanges causes a pivoting action of the actuator nozzle at the point of engagement. It may be referred to as a fulcrum point since the actuator nozzle operates as a lever. Thus, further tilting movement after engagement of the flanges 34 and 38 provides for rotation of the actuator nozzle about the fulcrum point and provides for a substantial component of the actuating force to be applied along the axis of the valve stem, thus serving to tighten the seal at the conical surface 20. Thus, by these measures a very adequate sealing action is obtained. This sealing action is important, particularly in nozzles of the type illustrated which are intended to emit a forceful spray through an orifice 24, because a substantial pressure must exist behind the orifice, and that pressure will be released whereever it can be.

In accordance with another improved feature of the present invention, the axis of the cylindrical bore of the tubular member 16 is tilted at an angle of about 5° away from the vertical. This is a rotational displacement clockwise as illustrated in FIG. 1, and a displacement which is in a plane common to the center lines of the bore of 16 and of the nozzle 24. This feature is particularly important in promoting ease of operation of axially operated valves. This tilt of the bore 16 pre-stresses the valve stem 14 to the right, as illustrated in the drawing. This pre-stressing is not drastic enough to cause the valve to open, or to damage the valve in any way. However, the pre-stressing is in such a direction that the actuation movement of the actuator nozzle, which is a counter-clockwise rotation as well as a downward and inward movement, causes the valve stem 14 to straighten up as well as being moved downwardly and inwardly. This promotes ease of operation of the valve, and it also enhances the force tending to seal the actuator to the valve stem at the conical surface 20. Thus, the operating tilting force on the actuator, which is to the left in the drawing, provides a greater component of sealing force at the conical seal 20 then would otherwise be available without the 5° tilt of the axis of the bore of the tubular member 16.

The above description of the 5° tilt feature has been given entirely in terms of a tilt of the bore of the tubular portion 16 of the actuator away from the vertical direction as related to the main axis of the actuator. Actually, the chief significance of this tilt is that the bore of 16 is tilted with respect to the plane defined by the upper surface of the outwardly extending flange 38 of the skirt portion 36. Thus, the tilt may also be described as a tilt of that plane. Thus, the plane of the flange should not be normal to the axis of the bore, but should be tilted about 5° away from the normal. This tilt may be described as downwardly in front (to the left) of the nozzle opening 24 and upwardly in the rear (to the right) of the nozzle opening 24. The other features of the actuator may be related to either axis, either the tilted axis of the bore, or an axis which is illustrated as vertical in the drawing, and which is normal to the plane defined by the upper surface of the flange 38. In the present embodiment, the other features, such as the cone angles of the skirt 36, are symmetrical about the vertical axis which is normal to the plane defined by the flange 38.

The drawing is idealized to the extent that a clearance space is shown between the upper surface of the flange 38 and the lower surface of the inwardly extending locking ring flange 34 on the right side of FIG. 1. Actually, this clearance is taken up entirely by the normal restoring force of the aerosol valve stem 14, which tries to maintain the valve stem in the vertical direction. The clearance between the flanges 38 and 34 is preferably minimized so as to limit the straightening effect of the restoring force of the valve 14. However, a number of manufacturing tolerances are involved in determining this clearance, and accordingly the actual "at rest" tilt angle of the valve stem 14 is bound to be less than 5°, and is more likely to be in the order of 3°. However, the 3° tilt provides all of the advantages explained above. Furthermore, the fact that the restoring force of the valve 14 takes up all of the clearance space between the flanges 34 and 38 at the right side in the drawing FIG. 1 provides for smooth operation of the valve with a minimum of lost motion before the valve begins to open.

The following portion of the description is largely directed to a preferred locking feature of the invention. With this locking feature, the actuator 10 can be rotated with respect to the locking ring 30 into a position from which the actuator cannot be operated to open the valve.

Figure 2:
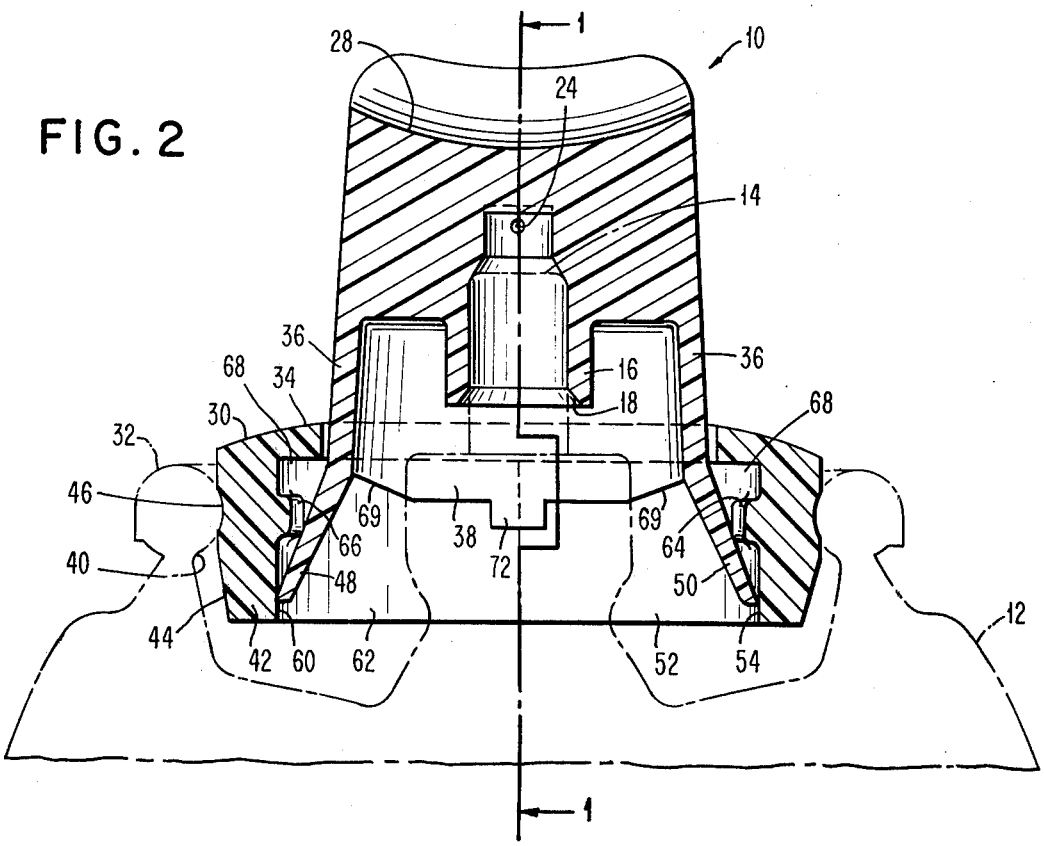
FIG. 2 is a sectional rear view of the actuator nozzle assembly of FIG. 1, taken at section 2—2 of FIG. 1.

FIG. 2 is a rear sectional view taken on section "2—2" of FIG. 1. In order to clarify the showing of FIG. 1, FIG. 2 includes a section line "1—1" which deviates in a minor way from the center line, showing where the section is taken in FIG. 2 for FIG. 1. As shown in FIG. 2, the radially outwardly extending flange 38 is interrupted at the sides of the skirt portion 36, and the skirt portion in the vicinity of this interruption is extended by integrally formed cantilever spring tabs 48 and 50. The interior surface of the lower portion of the locking ring 30 defines a hexagon, having six hexagon faces 52, 54, 56, 58, 60, and 62, some of which are illustrated in FIGS. 1 and 2, and all of which are shown in the bottom views of FIGS. 3 and 4 described more fully below. The cantilever spring flaps 48 and 50 cooperate with the hexagonal interior surface of locking ring 30 to provide an indexing movement in the rotation of the actuator nozzle 10, such that there is a substantial resistance to rotation as the spring flaps are rotated from engagement with one pair of the oppositely disposed hexagon flat surfaces to engagement with another pair. But there is a substantial reduction in turning force as the flaps become seated upon a particular pair of the hexagon flat surfaces. This may be referred to as an indexing, or detent, type of movement. It is very useful in the present invention, as will be described more fully below. The spring flaps 48 and 50 are designed to have the necessary amount of flexibility to provide the desired amount of resistance to rotation from one indexed position to another.

Figure 3:
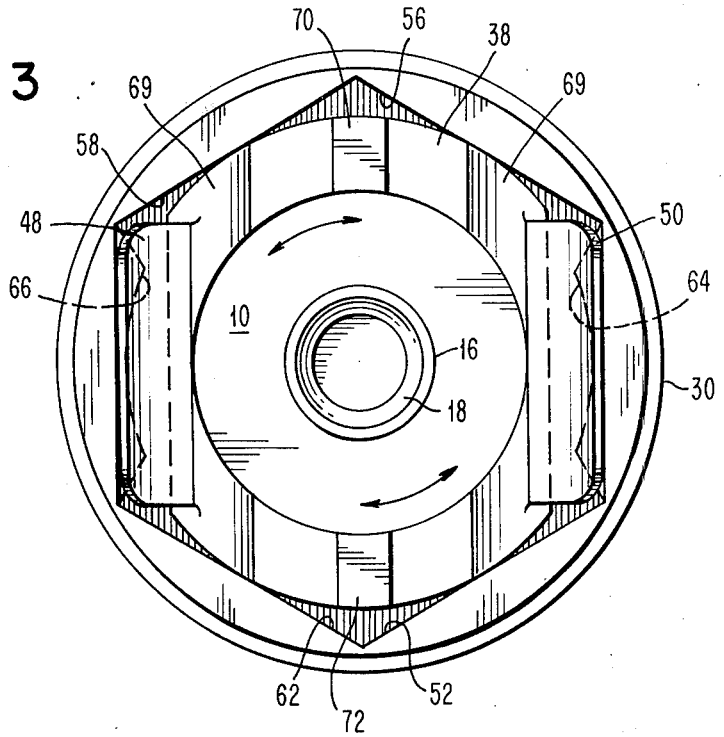
FIG. 3 is a bottom view of the actuator nozzle assembly of FIG. 1 as it appears when disassembled from the aerosol container, and with the actuator in an unlocked position.
Figure 4:
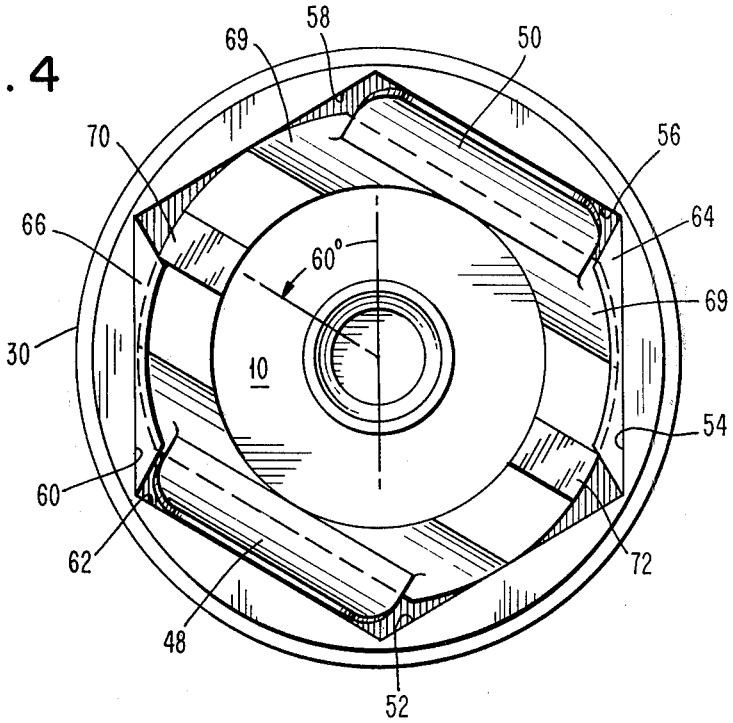
FIG. 4 is a bottom view corresponding to the bottom view of FIG. 3, but showing the actuator in a locked position.

FIG. 3 is a bottom view of the assembly illustrating it in the unlocked position, as shown in FIG. 2, and clearly illustrating the hexagonal faces of the opening in the bottom of the locking ring 30. FIG. 4 is a bottom view of the assembly, corresponding to FIG. 3, but showing the actuator nozzle 10 rotated 60° with relation to the locking ring 30, and in the locked position, to prevent undesired opening of the aerosol valve.

Referring again to FIG. 2, on two of the opposed flat faces 54 and 60 of the internal surface of the locking ring 30 there are provided locking abutments 64 and 66 which extend radially inwardly. When the actuator nozzle is rotated with respect to the locking ring 30 from the position illustrated in FIGS. 1, 2, and 3, into the position illustrated in FIG. 4, then the radially outwardly extending flange 38 at the lower portion of the actuator nozzle skirt 36 is moved into the cavity shown at 68 above the abutments 64 and 66. This interlocks the flange 38 with the abutments 64 and 66, and prevents any downward or tilting movement of the actuator nozzle 10 which could cause opening of the valve of the aerosol. The bottom edges of the flange 38 are tapered, as indicated at 69, to facilitate entry of the flange 38 into the cavities 68. This permits ease of operation and a close fit. It also compensates for any initial misalignment. As shown in the bottom views of FIGS. 3 and 4, the locking abutments 64 and 66 preferably have arcuately formed faces so that the edges of these abutments form arcuate engagements with substantial portions of the edges of the radial flange 38 of the actuator nozzle, even though the overlap of these parts is not large, as illustrated in the locked position shown in FIG. 4.

On the underside of the radially outwardly extending flange 38, there are provided integrally molded stops 70 and 72 which come to rest against the edges of the locking abutments 66 and 64 when the actuator nozzle is in the locked position, as illustrated in FIG. 4. This provides a positive indication to the user that the actuator nozzle is in the locked position, and prevents further rotation.

The hexagonal configuration of the interior of the locking ring 30, and the related features of the geometry of the preferred embodiment illustrated in FIGS. 1–4 provide for two different locked positions. Thus, from the unlocked position illustrated in FIG. 3, the actuator nozzle can be rotated either clockwise or counterclockwise by 60° into a locked position. The counterclockwise locked position is illustrated in FIG. 4. In either of these locked positions, the stop members 70 and 72 are effective to stop the rotation by engagement against the abutment members 66 and 64.

When the actuator nozzle is rotated to the unlocked position, as illustrated in FIG. 2, there is no interference by the abutments 64 and 66, or by any other part of the locking ring 30, with downward or tilting movement of the actuator nozzle.

The bottom views of FIGS. 3 and 4 are simplified to the extent that the details are not fully shown within the center bore 16, since such details are not required for an understanding of the invention.

Many modifications may be made without departing from the spirit and scope of the invention. For instance, the locking abutments 64 and 66 may be moved down to the lower inside edge of the hexagon faces 60 and 54 so as to abut with the lower tips of the cantilever spring flaps 48 and 50 to thus provide the locking action in cooperation with the tips of the spring flaps rather than with the flange 38. Such a modification is illustrated in FIGS. 5, 6, and 7 and described more fully below.

Furthermore, with the hexagon shape, it is feasible to provide three equally spaced locking abutments, for instance, in association with the hexagon faces 52, 56, and 60, and to provide three equally spaced cantilever spring flaps, instead of the two illustrated. This again provides a configuration in which a 60° rotation causes locking, and a 60° counter rotation causes unlocking. It is also possible to use other polyhedron shapes on the inner surface of the locking ring 30, preferably employing even numbers of sides. For instance, it is quite practical to employ an octagon shape with four equally spaced locking abutments and four equally spaced cantilever spring flaps. The modified embodiment of FIGS. 5, 6, and 7, which is described in detail immediately below serves to illustrate this modification.

Figure 5:
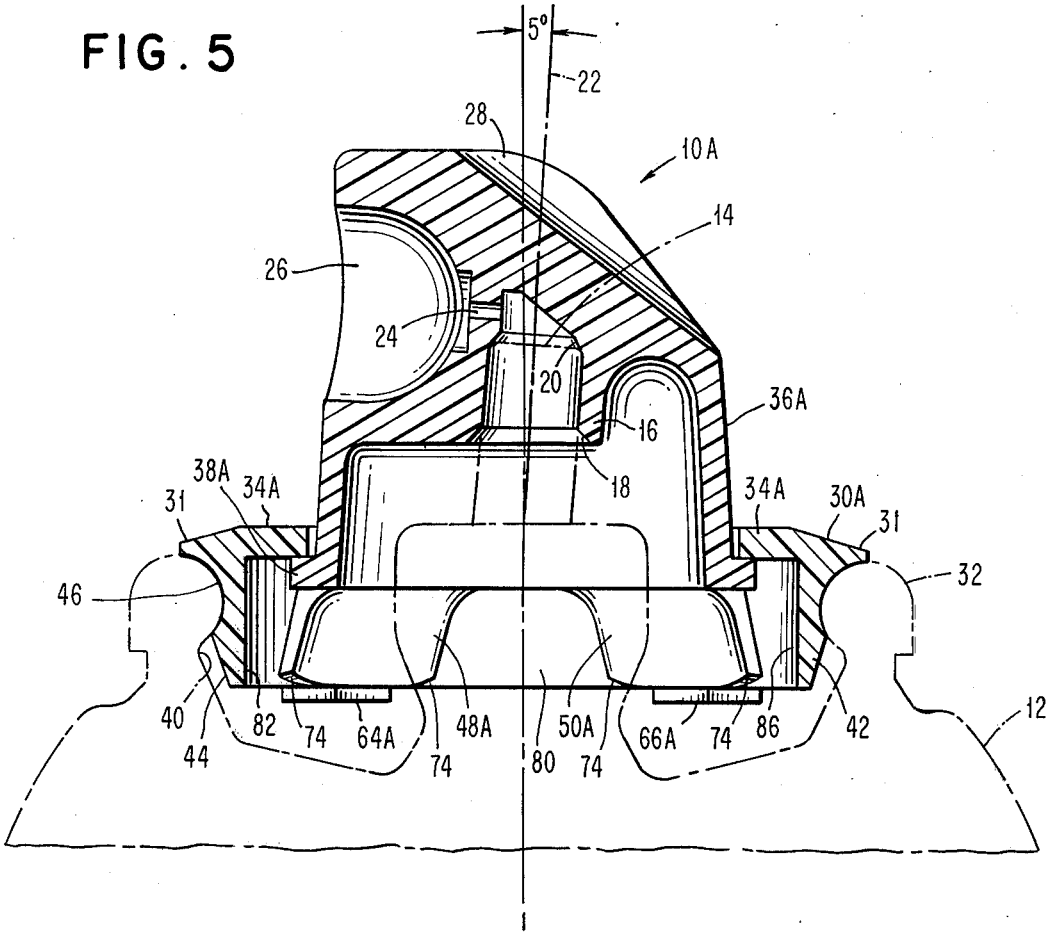
FIG. 5 is a sectional side view of a modified embodiment.
Figure 6:
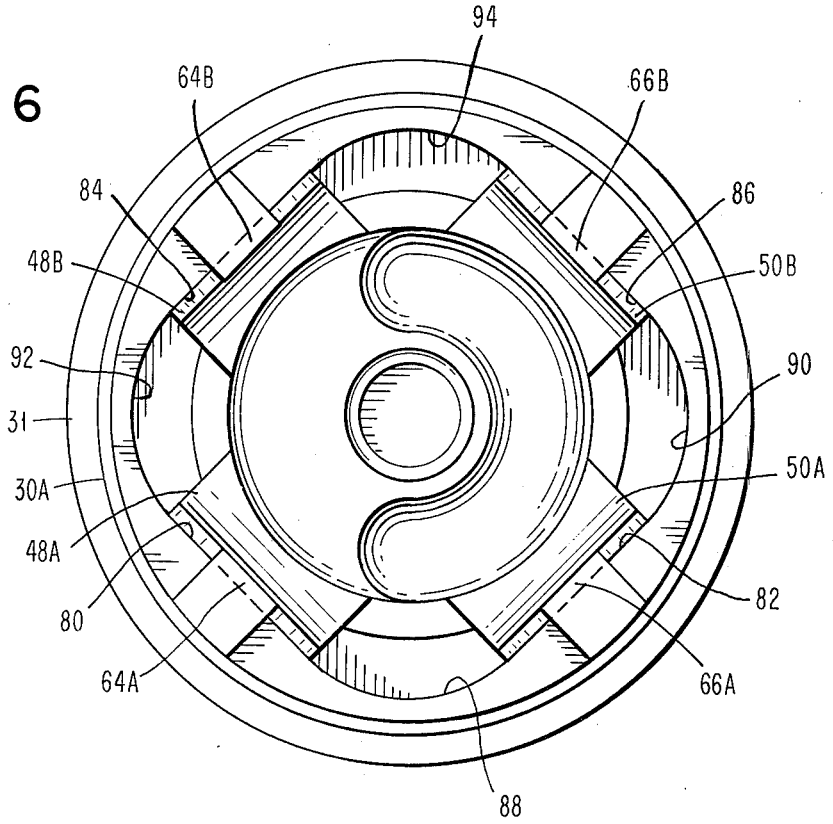
FIGS. 6 and 7 are bottom views of the modification of FIG. 5 respectively in the locked and unlocked positions.
Figure 7:
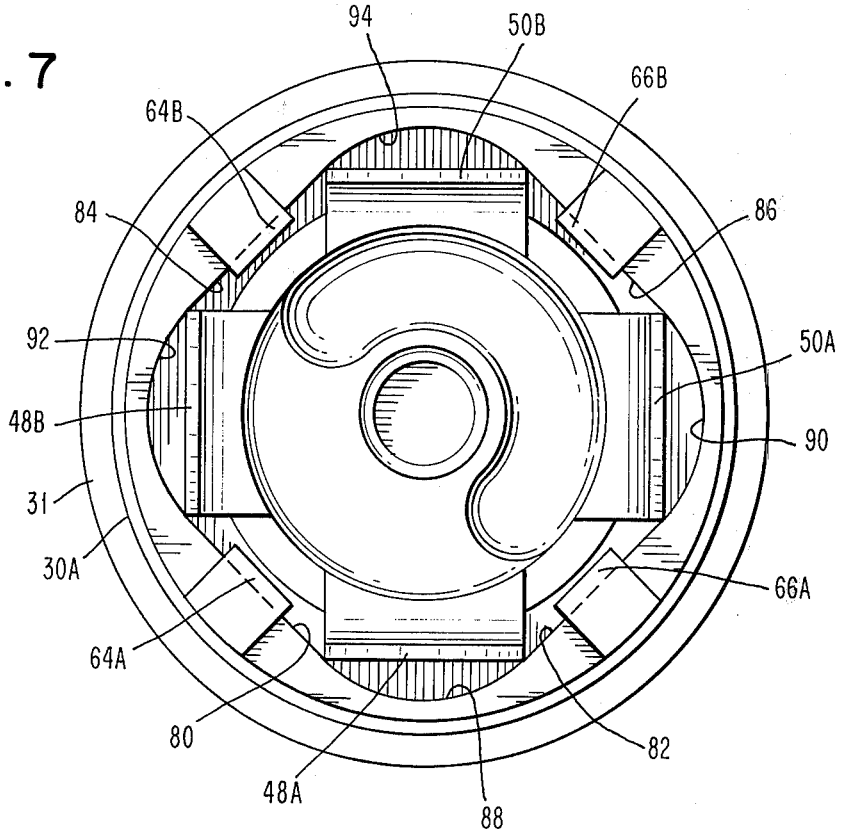

The modified embodiment of FIGS. 5, 6, and 7 is generally similar to the embodiment of FIGS. 1–4 in many ways, and corresponding parts and components having the same features and functions in the FIGS. 5–7 embodiment are numbered the same as corresponding components in the FIGS. 1–4 embodiment, and are not separately described below. The main structural changes in FIGS. 5–7 are: (1) a change in position of the locking abutments 66 and 64 from a position above the tips of the cantilever spring flap members 48 and 50 to positions illustrated at 64A and 66A in FIG. 5 beneath the tips of the cantilever spring flaps 48*a* and 50*a*, (2) the change from two cantilever spring flaps and a hexagon internal shape for the locking ring to four cantilever spring flaps and a square (or octagon) internal shape for the locking ring, (3) the addition of a radially outwardly extending lip or flange 31 at the upper edge of the locking ring 30A for greater ease in holding the ring against rotation as described in detail below.

Referring in more detail to FIG. 5, at the lower edges of the locking ring 30A, there are provided locking abutments 64A and 66A which engage with the lower edges of the cantilever spring flap indexing members 48A and 50A. The change in the position of the locking abutments substantially simplifies the structure of the locking ring, making it easier to fabricate. Furthermore, since the cantilever spring flaps need not accomodate for the protrusion of the locking abutments above the tips of the spring flaps, as illustrated in FIG. 2, the diameter of the skirt portion 36A in the embodiment of FIGS. 5–7 may be somewhat larger in relation to the diameter of the locking ring 30A. This is believed to enhance the appearance of the actuator. As illustrated in FIG. 5, the lower end surfaces of the cantilever spring flaps 48A and 50A include curved cam portions indicated at 74 at the corners thereof in order to cam the ends of the cantilever spring flaps into secure engagement with the locking abutments 64A and 66A with ease as the actuator button 10A is rotated in relation to the locking ring 30A into the locked position illustrated in FIG. 5.

FIG. 6 is a bottom view of the embodiment of FIG. 5, again illustrating the actuator in the locked position. As illustrated more clearly in FIG. 6, the embodiment of FIGS. 5–7 preferably includes four locking cantilever flaps 48A, 50A, 48B, and 50B which, in the locked position illustrated in FIG. 6, respectively engage four equally circumferentially spaced flat inner surface portions of the locking ring 30A designated 80, 82, 84, and 86. The actuator is unlocked by rotating it 45° in either direction with respect to the locking ring 30A. The unlocked position achieved by rotation in a counterclockwise direction, as viewed from the bottom, is illustrated in FIG. 7. In this position, the four cantilever flaps 48A, 50A, 48B, and 50B are respectively positioned intermediate the locking abutments 64A, 66A, 64B, 66B, so that they are disengaged from the locking abutments, thus permitting acutating movement of the actuator 10A.

In this unlocked position, the cantilevered spring flaps 48A, 50A, 48B, and 50B, are respectively positioned opposite to internal wall portions of the locking ring 30A designated 88, 90, 92, and 94. It is apparent that these internal wall portions 88-94 could be additional flat surfaces while perfectly accomodating the cantilever spring flaps associated therewith. In such a configuration, the internal surface of the locking ring 30A would represent an octagon. However, it has been found to be unnecessary to provide such additional flat surfaces, and instead, the surfaces 88-94 simply represent radiused curved walls joining the adjacent flat walls so that the bottom plan view of the inner walls of the locking ring simply represent a square with very generously radiused corners. It will be appreciated, that this shape functions substantially similarly to an octagon shape and may be considered as illustrating how an octagon shape works. The principal exception is that the actuator is somewhat more easily moved into the unlocked position, and is more freely tiltable when it is in the unlocked position illustrated in FIG. 7 than it would be if the surfaces 88–94 were flat. Accordingly, the radiused corners are preferred.

As illustrated in FIG. 5, the nozzle 24 is preferably aligned rotationally at 45° to the center lines of the adjacent cantilever spring flaps 48A and 48B. Thus, the nozzle 24 is at a rotational alignment which is midway between the two flaps. This provides the advantage that the rocking or tilting motion of the actuator in the unlocked position shown in FIG. 7, is most easily accommodated by the reduced corners 88–94 of the interior surface of the locking ring 30A.

An important advantage of the embodiment of FIGS. 5–7 over the embodiments of FIGS. 1–4 is specifically related to the arrangement in which the locking action takes place between the locking abutments such as abutments 64A and 66A and the lower ends of the associated cantilever spring flaps. This advantage resides in the ease of initial assembly of the actuator button 10A with the locking ring 30A. Thus, the locking ring 30A may be threaded over the top of the actuator 10A in the rotational alignment for the locked position, and the cantilever spring flaps, such as 48A and 50A are resilient enough so that they can be forced to spring inwardly as the locking abutments 64A and 66A are pushed over the outside surfaces of those flaps and snapped into placed beneath the ends of the flaps. Alternatively, the locking ring 30A may be supported upside down by an annular support, and the actuator 10A may be inserted and snapped into place in the inverted position through the inverted bottom of the locking ring. In either case, this mode of assembly is very easily accomplished without the need for a rotational motion during assembly. Also, this mode of assembly results in the combination of the actuator nozzle and the locking ring in the locked position which is desired for shipment. By contrast, the embodiment of FIGS. 1–4 requires assembly first in the unlocked position and then relative rotation to achieve the locked position.

In all of the embodiments of the invention involving the locking feature with cantilever spring flaps, the unlocking rotation of the actuator which is required before the valve can be opened is complicated enough so that small children cannot unlock the container. As a further precaution, the cantilever spring flaps can be designed to require a substantial rotational force to accomplish the unlocking motion, a force sufficiently high so that small children are incapable of providing enough force to unlock the container.

The locking ring 30 in the embodiment of FIGS. 1–4, or locking ring 30A of the embodiment of FIGS. 5–7 may be designed to provide a very secure attachment to the upper part 32 of the associated aerosol container so that the locking ring cannot be rotated with respect to the aerosol container by the torque normally required for locking or unlocking the actuator by rotation thereof. Thus, the actuator can be locked or unlocked by firmly gripping the aerosol container in one hand, and by simply rotating the actuator with the other hand. This rotation movement is complicated enough to prevent inadvertent operation of the valve, and to prevent unlocking and actuation of the valve by small children.

However, it has been discovered that it is possible to incorporate an important additional safety feature in accordance with the present invention by simply designing the locking ring 30 or 30A so that the fit of the locking ring at the top of the aerosol container is not so tight that rotation of the locking ring is prevented in response to the unlocking rotational torque of the actuator. Thus, with this modification, if the user of the invention simply holds the aerosol container in one hand and attempts to rotate the actuator with the other hand, the locking ring 30, 30A simply rotates with the actuator, and in the absence of relative rotation between the actuator and the locking ring, the actuator is not unlocked. Thus, with this modification, it is necessary for the user to place one or two fingers on the upper surface of the locking ring 30, 30A to impart additional resistance to rotation of the locking ring in order to achieve a rotation of the actuator relative to the locking ring so as to unlock the actuator. This additional complication in the manipulation required for unlocking is effective to prevent unlocking and actuation by children who may realize that the actuator must be rotated, but do not appreciate the subtle requirement that fingers must restrain the locking ring as the actuator is rotated.

In the embodiment of FIGS. 5–7, a radial extension lip 31 has been added at the outer upper periphery of the locking ring to enable the operator to restrain more effectively the rotation of the locking ring 30A with respect to the aerosol container.

The upper surface of the locking ring 30 or 30A may be grooved or may have other roughened surface features or surface discontinuities, if desired, to promote ease in holding the locking ring against rotation during corresponding rotation of the actuator between the locked and the unlocked positions. However, a smooth surface has the advantage of helping to prevent unauthorized opening of the container by children, even though they may have discovered the principle of operation.

The 5° tilt feature illustrated at 22 in FIG. 5 is especially useful in achieving a tilt actuation movement from an aerosol valve which is intended and designed primarily for actuation by axial inward motion. If the valve of the aerosol container is designed for tilt actuation, the 5° pre-tilt is not necessary, and the internal cylindrical surface of 16 may be exactly perpendicular to the plane of the upper surface of flange 38A. The 5° pre-tilt may also be omitted where it is not desired to convert the actuation movement of an axially operated valve to the tilt motion. In such an embodiment, the finger-engaging surface 28 of the actuator is preferably not tilted as much as is illustrated in FIG. 5, but the top surface of the actuator is more nearly flat and level.

Regardless of the above-mentioned modifications, the locking features illustrated and described in connection with FIGS. 5–7 and also in connection with FIGS. 1–4 may remain the same, and are fully effective to lock the valve against actuation, no matter whether the valve is an axially operated valve or a tilt actuated valve.

While this invention has been shown and described in connection with particular preferred embodiments, various alterations and modifications will occur to those skilled in the art. Accordingly, the following claims are intended to define the valid scope of this invention over the prior art, and to cover all changes and modifications falling within the true spirit and valid scope of this invention.

I claim:

1. An actuator nozzle assembly for an aerosol container of the type having a tubular valve stem protruding at the center of one axial end thereof, comprising an actuator which is rotatable with respect to the valve stem when assembled therewith, said actuator comprising a member defining a cylinder surface operable to telescopically interfit with the valve stem to have a sliding fit therewith, said actuator including a skirt portion having a radially outwardly extending flange, the upper surface of said flange generally defining a plane, a locking ring arranged for assembly to the upper edge portion of the aerosol container, said locking ring having a radially inwardly extending flange portion which interlocks with the upper surface of said radially outwardly extending flange of said skirt portion of said actuator to maintain said actuator in assembled relationship with the valve stem of the aerosol container, said locking ring including at least two integral locking abutments extending radially inwardly from the inside walls thereof beneath said skirt portion and arranged to abut lower surfaces of said skirt portion to thereby lock said actuator against downward movement to prevent actuation of the associated aerosol container valve, said lower surfaces of said skirt portion engaged by said locking abutments having reduced radius portions corresponding to each of said locking abutments, said actuator being rotatable to position said reduced radius portions opposite to said abutments to thereby disengage said skirt portion from said locking abutments to unlock said actuator, said skirt portion of said actuator including a plurality of cantilever spring members extending downwardly therefrom and arranged to exert spring forces radially outwardly against the inner surface of said locking ring;

said inner surface of said locking ring including discontinuities operable in cooperation with said cantilever spring members to provide a detent spring force for rotational indexing operation of said actuator between at least one locked rotational position in which said skirt portion is locked with said locking abutments and at least one unlocked rotational position in which said skirt portion is disengaged from said locking abutments, said lower surfaces of said skirt portion engaged by said locking abutments comprising the lower ends of said cantilever spring members.

2. An actuator nozzle assembly as claimed in claim 1 wherein said discontinuities in said inner surface of said locking ring are provided by forming said surface as a regular polygon having an even number of sides.

3. An assembly as claimed in claim 2 wherein said cantilever spring members include relatively straight lower edges for physical engagement with said inner surface of said locking ring, said cantilever spring members being matched with individual pairs of the sides of the polygon shape of said inner surface of said locking ring to provide a minimum of rotation resisting force when said straight lower edges of said spring members are aligned with a pair of straight sides of said polygon.

4. An assembly as claimed in claim 3 wherein said polygon is an octagon.

5. An assembly as claimed in claim 4 wherein said actuator includes four integrally formed cantilever spring members equally spaced around the circumference thereof, and wherein four of said locking abutments are provided at four alternately arranged faces of the octagon defined by said inner surface of said locking ring for simultaneous engagement with the four ends of said cantilever spring members when said actuator is in the locked position.

6. An assembly as claimed in claim 3 wherein said polygon is a square.

7. An assembly as claimed in claim 6 wherein said actuator includes four integrally formed cantilever spring members equally spaced around the circumference thereof, and wherein there are provided four of said locking abutments respectively disposed in the central portion of each side of said square defining the inner surface of said locking ring for engagement by the ends of said cantilever spring members in the locked position, said actuator being rotatable by an angle of 45° to the unlocked position in which said cantilever spring members are disposed in the corners of said square defining the inner surface of said locking ring.

8. An assembly as claimed in claim 7 wherein said corners of said inner surface of said locking ring are generously radiused to permit a reduced outer radius for said ring.

9. An actuator nozzle assembly for an aerosol container of the type having a tubular valve stem protruding at the center of one axial end thereof, comprising an actuator which is rotatable with respect to the valve stem when assembled therewith, said actuator comprising a member defining a cylinder surface operable to telescopically interfit with the valve stem to have a sliding fit therewith, said actuator including a skirt portion having a radially outwardly extending flange, the upper surface of said flange generally defining a plane, a locking ring arranged for assembly to the upper edge portion of the aerosol container, said locking ring having a radially inwardly extending flange portion which interlocks with the upper surface of said radially outwardly extending flange of said skirt portion of said actuator to maintain said actuator in assembled relationship with the valve stem of the aerosol container, said locking ring including at least two integral locking abutments extending radially inwardly from the inside walls thereof beneath said skirt portion and arranged to abut lower surfaces of said skirt portion to thereby lock said actuator against downward movement to prevent actuation of the associated aerosol container valve, said lower surfaces of said skirt portion engaged by said locking abutments having reduced radius portions corresponding to each of said locking abutments, said actuator being rotatable to position said reduced radius portions opposite to said abutments to thereby disengage said skirt portion from said locking abutments to unlock said actuator, said skirt portion of said actuator including a plurality of cantilever spring members extending downwardly therefrom and arranged to exert spring forces radially outwardly against the inner surface of said locking ring, said inner surface of said locking ring including discontinuities operable in cooperation with said cantilever spring members to provide a detent spring force for rotational indexing operation of said actuator between at least one locked rotational position in which said skirt portion is locked with said locking abutments and at least one unlocked rotational position in which said skirt portion is disengaged from said locking abutments, said locking ring having a circumferential groove in a surface thereof to frictionally engage and secure said locking ring to the upper edge portion of the associated aerosol container.

10. An assembly as claimed in claim 9 wherein said locking ring is dimensioned to have a tight fit in the frictional engagement of said locking ring with the upper edge portion of the associated aerosol container so as to prevent rotation of said locking ring with respect to the aerosol container during the rotational indexing operation of said actuator between said locked rotational position and said unlocked rotational position.

11. An assembly as claimed in claim 9 wherein said locking ring is dimensioned at said circumferential groove surface for frictional engagement with the edge portion of the associated aerosol container which is sufficiently loose to permit said locking ring to rotate in response to said detent spring force to thereby prevent relative rotation of said actuator between the locked position and the unlocked position unless said locking ring is directly held against rotation independent from the associated aerosol container.

12. An assembly as claimed in claim 11 wherein said locking ring includes a radially outwardly extending flange portion positioned to be exposed when said ring is assembled upon the associated aerosol container to provide an improved grip for restraining said locking ring against rotation to permit relative rotation of said actuator between said locked position and said unlocked position.

13. An assembly as claimed in claim 12 wherein said circumferential groove is an external circumferential surface of said locking ring to engage with an inner upper edge portion of the associated aerosol container, said radially outwardly extending flange being positioned above said circumferential groove to extend out over the upper edge portion of the aerosol container.

14. An assembly as claimed in claim 11 wherein the upper surface of said locking ring is roughened to provide for ease of engaging and holding said ring against rotation during movement between the locked and unlocked positions of said actuator.

* * * * *